United States Patent [19]

Ehrhardt et al.

[11] 4,327,939

[45] May 4, 1982

[54] CHEMICAL CARBONLESS COPY PAPER AND IMAGE RECEPTOR MEDIUM THEREFOR

[75] Inventors: Gerry H. Ehrhardt, West Des Moines; Gene D. Carlson, Ankeny, both of Iowa

[73] Assignee: Frye Copysystems, Inc., Des Moines, Iowa

[21] Appl. No.: 159,587

[22] Filed: Jun. 16, 1980

[51] Int. Cl.[3] ..... B41M 5/16; B41M 5/22

[52] U.S. Cl. ..... 282/27.5; 427/150; 428/411; 428/537; 428/914

[58] Field of Search ..... 106/21, 31; 282/27.5; 427/150, 151, 152; 428/307, 411, 537, 913, 914, 323

[56] References Cited

U.S. PATENT DOCUMENTS

| | | | |
|---|---|---|---|
| 2,505,475 | 4/1950 | Green | 282/27.5 |
| 3,016,308 | 1/1962 | MaCaulay | 282/27.5 |
| 3,576,660 | 4/1971 | Bayless et al. | 282/27.5 |
| 3,995,088 | 11/1976 | Garner et al. | 282/27.5 X |
| 4,085,949 | 4/1978 | Asao | 282/27.5 |
| 4,226,442 | 10/1980 | Carlson et al. | 282/27.5 X |
| 4,238,130 | 12/1980 | Burri | 282/27.5 X |

OTHER PUBLICATIONS

Color Index, "Spirit Blue CR" (C.I. 689), Jan. 1924.
Color Index, "Opal Blue" (C.I. 688), Jan. 1924.
Sherwin Williams Technical Bulletin AB-47.

*Primary Examiner*—Bruce H. Hess
*Attorney, Agent, or Firm*—Nims, Howes, Collison & Isner

[57] ABSTRACT

Improved receptor or CF coating composition for chemical carbonless copy paper employing spirit blue in carbinol form as a dye precursor type chromogenic reagent material.

4 Claims, No Drawings

CHEMICAL CARBONLESS COPY PAPER AND IMAGE RECEPTOR MEDIUM THEREFOR

This invention relates to pressure sensitive information transfer and duplicating systems and particularly to improved chemical type transfer and reproduction media for effecting duplicative image transfer on sheet material in response to selectively applied pressure and to processes for forming the same.

Pressure sensitive image transfer media of diverse character are widely employed in the information recording and duplicating arts. Chemical type or so-called "carbonless" pressure sensitive transfer and duplicating systems, wherein a visable image is formed by the selective chemical reaction of two essentially colorless reagents, have been long recognized as a viable expedient for the formation of duplicate copy material. Such systems normally broadly comprise a substrate supported coating that contains a first normally inactive chemical reagent material that is selectively transferable in response to applied pressure into a reaction providing and color producing relationship with a second normally inactive chemical reagent material contained within or comprising a second coating disposed on the surface of an interfacially contiguous second substrate. Conventionally illustrative of such chemical type reproduction systems are transfer and duplicating systems wherein the rear surface on one paper sheet substrate is provided with a coating and which sheet is then termed a "CB" (i.e. coated back) sheet and the front side of that same and/or a separate paper sheet substrate is provided with a coating which is then termed a "CFB" (i.e. coated front and back) or "CF" (i.e. coated front) sheet, respectively. When the coatings on a CB and a CF sheet are placed in interfacially contiguous relation and subjected to selectively applied pressure, as by the pressure of a stylus or the impact of a typewriter key on the obverse surface of the CB sheet, the operative and usually colorless chemical reagents in such coatings are brought into co-reactive relationship, as for example on the surface of the CF sheet, to produce a colored image conforming to the contour of the selectively applied pressure member.

Such chemical type pressure sensitive transfer and duplicating systems are in widespread and expanding use at the present time for the making of multiple copies of selectively recordable duplicative information on sheet material, such as paper and the like, due, at least in part, to their basic cleanliness and to the fact that the color producing reagents are inactive until placed into operative co-reactive relationship in response to selective application of pressure.

Although it was early recognized, as for example in the Gill U.S. Pat. No. 1,781,902, that many colorless chemical reagents were capable of producing a visable colored image upon interraction therebetween, most of the systems in wide commercial usage at the present time employ a colorless organic dyestuff as a dye precursor in encapsulated liquid form distributed within the CB sheet coating and an electron accepting material in the CF sheet coating. When such CB and CF sheet coatings are placed in contiguous interfacial relation, the application of pressure effects a rupture of the liquid dyestuff confining capsular elements in the area of applied pressure to effect a release of the dye precursor material and selective transfer of at least a portion thereof into coreacting and color producing relationship with the electron accepting material in the contiguous coating on the CF sheet with the resulting formation of a duplicative image thereon.

Some early and relatively recent patents that illustratively disclose chemical type or so-called "carbonless" transfer media employing encapsulated dye precursor materials as the chromogenic reagent in the CB coating and electron accepting materials as the chromogenic reagent in the CF coating are U.S. Pat. No. 2,712,507 (1955) to Green; U.S. Pat. No. 2,730,456 (1956) to Green et al.; and U.S. Pat. No. 3,455,721 (1969) to Phillips et al.

Other more recent patents that illustratively disclose the disposition of the dye precursor material in the CF coating and encapsulated electron accepting material in the CB coating include U.S. Pat. No. 3,787,325 (1974) to Hoover and U.S. Pat. No. 3,984,168 (1975) to Brockett et al.

While considerable effort has been directed over the past years to the improvement of encapsulation techniques and to the provision of improved CB type coatings, the increasing expense of conventionally employed dye precursor materials and their degradable sensitivity to both light and water have posed continuing and as yet unsolved problems in the search for improved and lower cost chemical carbonless transfer systems.

This invention may be briefly described, as an improved solvent system type of CF coating material employing tri (p-phenylamino-phenyl) hydroxy methane, sometimes coloquially and less precisely identified as spirit blue in carbinol form as a dye precursor selectively dispersed throughout an alkaline biased carrier film.

Among the advantages attendant the practice of the subject invention is the permitted use of a broadly acid responsive, inexpensive and readily available dye type product as a dye precursor. Additional advantages include the provision of a receptor coating that is completely water and light stable and, absent interreaction with available acidic material, is highly resistant to premature actuation normally resulting from extreme climatic conditions.

The principal object of this invention is the provision of an inexpensive, light and water stable dye precursor containing receptor coating for chemical carbonless copy systems.

Another object of this invention is the provision of a receptor coating for chemical carbonless copy systems that employs tri (p-phenylamino-phenyl) hydroxy methane as a chromgenic reagent material.

A further object of the invention is the provision of a light and water stable receptor coating for chemical carbonless copy systems that employs tri (p-phenylamino-phenyl) hydroxy methane dispersed throughout an alkaline biased carrier film.

Other objects and advantages of the subject invention will become apparent from the following portions of this specification which describe, in accord with the mandate of the patent statutes, the principles of the invention and best mode presently contemplated by the inventors for carrying out said inventions.

The improved CF or receptor coating comprises the solid residue of an applied alkaline biased homogeneous mixture of an evaporable non-polar hydrocarbon solvent, a chemically neutral or alkaline resinous binder, an opacifier-filler and tri (p-phenylamino-phenyl) hydroxy methane as a dye precursor type of chromogenic reagent material. Such solidified CF coating is further characterized by the presence of such dye precursor in solid form and which dye precursor is insoluble in water. Optionally but desirably included therein is a dispersant to assist in the uniform dispersion of such dye precursor throughout the mix and a thickener to provide the requisite viscosity properties to facilitate the coating of the mix in accord with the particular requirements of the coating equipment employed.

The evaporable liquid vehicle must be of non-polar character and a solvent for the tri (p-phenylamino-phenyl) hydroxy methane dye precursor component. Suitable non-polar organic solvents include acetone, toluene, heptane and naphtha, with toluene being presently preferred for use.

A presently preferred CF coating comprises the solid residue of an applied intermix of an evaporable non-polar solvent, suitably 50 to 80 parts of toluene, having dissolved therein at least about 7 to 20 parts of a chemically neutral or alkaline resinous binder, suitably polyvinylacetate. Added thereto is about 0.1 to 0.5 parts of a dispersant and about 0.1 to 4 parts of dry potassium hydroxide to provide an alkaline bias to the mix and to minimize inadvertent color reactions in the CF coated sheets. Also included in the mix is about up to 45 parts of opacifier-fillers, suitably up to about 20 parts finely divided titanium dioxide and the remainder of calcium carbonate; and about 0.5 to 5 parts of tri (p-phenylamino-phenyl) hydroxy methane as the chromogenic reagent.

The nature of the binder is not attended with any particular degree of criticality as long as it is of chemically neutral or of alkaline character and functions as a binding agent for the opacifier-filler and the color precursor, with both of the latter being in solid form. A preferred binder material which is readily soluble in the above described evaporable non-polar solvent carrier comprises polyvinylacetate, suitably Vinac B-15, as manufactured by Air Products & Chemicals Company.

A presently preferred dispersant comprises sodium salt of polymeric carboxylic acid such as Tamol 731 as manufactured by Rohm & Haas Company of Philadelphia, Pa.

The opacifier-filler, which serves both to enhance the appearance of the coating and to cooperate in the uniform distirbution and spaced separation of the solid color precursor in the CF coating must also be of neutral or alkaline character. Such filler may suitably comprise calcium carbonate such as Albaglos as manufactured by Chas. Pfizer & Co. This material has a pH of 9.4, a specific gravity of 2.7 and an average particle size of about 0.75 microns. Another suitable opacifier-filler employed in conjunction with the above is Unitane 0-110 titanium dioxide as manufactured by the American Cyanamid Company. This material has a minimum $TiO_2$ content of 99%, a pH of about 7.7 and a specific gravity of about 3.9.

As noted above, the chromogenic reagent employed is tri (p-phenylamino-phenyl) hydroxy methane.

The tri (p-phenylamino-phenyl) hydroxy methane dye precursor is indirectly depicted in the Pigment Handbook (Vol. I) published by John Wiley & Sons (Ed. Temple C. Patton; 1973), as having the following chemical structure:

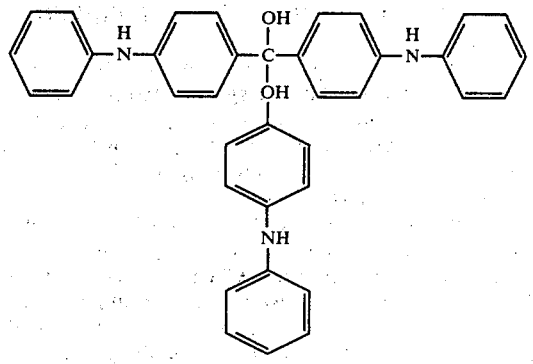

The above depicted incorporation of the hydroxyl group [OH] intermediate the methane carbon atom [C] and the phenyl group

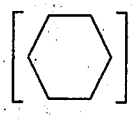

is incorrect and the correct structural formula for the illustrated material is as follows:

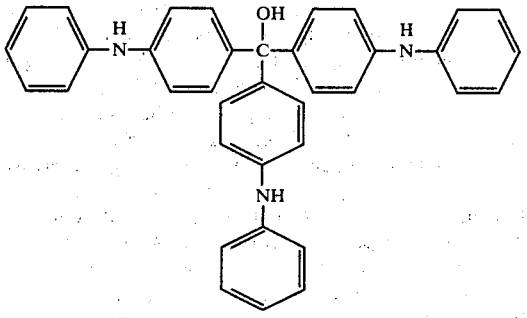

The above text indicates however that the following chemical composition is probably also present:

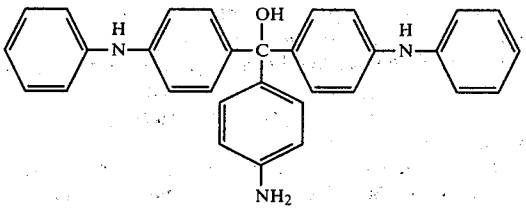

The preferred tri (p-phenylamino-phenyl) hydroxy methane dye precursor as identified above is obtainable from The Sherman Williams Company. As indicated in Sherman Williams technical bulletin AB-47 the preferred tri (p-phenylamino-phenyl) hydroxy methane dye precursor (therein identified as "Spirit Blue Carbinol Form") in the presence of an acid pH forms an intensely colored dye stuff known as solvent Blue (CI No. 42760).

Transposition into or from its colorless form is solely pH responsive, with intense color being produced in an acid pH environment. Alkaline biasing of the coating is maintained by the selective utilization of alkaline biased constituants as set forth above and by the inclusion of small amounts of potassium hydroxide when necessary or desirable.

In the production of the above described receptor coating for CF sheets, a liquid mixture is first formed by intermixing the non-polar toluene solvent with the polyvinylacetate binder material, the dispersant, the potassium hydroxide (to cast the pH of the solution to the alkaline side) with continuous agitation until all solids are completely dissolved after which the organic dyestuff dye precursor material is added with continued stirring until it is dissolved. To the above liquid mixture is then added the requisite amounts of calcium carbonate and the titanium dioxide opacifier-filler. Such addition should be accompanied by continuous stirring of such constituents in the liquid vehicle to obtain a uniform dispersion thereof.

The specified dye precursor can be added in its colorless form as a powder, or it can be added in its colored form as Solvent Blue 23. If the latter colored form is so utilized, the alkaline cast of the other constitutents, including any necessary amounts of potassium hydroxide, will cause the dye to revert to its colorless or carbinol form in the mixture.

By way of specific example the following formulation has provided an improved but yet inexpensive CF sheet coating.

| EXAMPLE I | |
|---|---|
| Toluene | 53.0 |
| Potassium Hydroxide | 1.0 |
| Calcium Carbonate | 31.8 |
| tri (p-phenyl-amino-phenyl) hydroxy methane | 1.0 |
| Polyvinylacetate | 13.0 |
| Dispersant | 0.2 |

| EXAMPLE II | |
|---|---|
| Toluene | 53.0 |
| Potassium Hydroxide | 1.0 |
| Calcium Carbonate | 27.0 |
| Titanium Dioxide | 4.8 |
| tri (p-phenyl-amino-phenyl) hydroxy methane | 1.0 |
| Polyvinylacetate | 13.0 |
| Dispersant | 0.2 |

Having thus described our invention, we claim:

1. A chemical type copy paper, comprising planar sheet material having a non-transferable image producing receptor layer disposed on one surface thereof;

said image receptor layer comprising the solid residue of an applied alkaline biased liquid intermixture of an evaporable non-polar liquid hydrocarbon solvent vehicle, a resinous non-acidic binder, opacifier-filler material and colorless tri (p-phenylamino-phenyl) hydroxy methane dispersed therewithin and being selectively convertable into a color producing condition upon interreaction with electron accepting acidic chromogenic reagent material.

2. A copy paper as set forth in claim 1 further including a dispersant and sufficient dry potassium hydroxide to assure an alkaline bias to said receptor layer.

3. A chemical type copy paper, comprising planar sheet material having a non-transferable image producing receptor layer disposed on one surface thereof;

said image receptor layer comprising the solid residue of an applied alkaline biased liquid intermixture of 50 to 80 parts of an evaporable non-polar liquid hydrocarbon solvent vehicle selected from the group consisting of toluene, acetone, heptane and naphtha; about 7 to 20 parts of a non-acidic resinous binder; opacifier-filler material selected from the group consisting of titanium dioxide and calcium carbonate and about $\frac{1}{2}$ to 5 parts of colorless tri (p-phenylamino-phenyl) hydroxy methane dispersed therewithin and being selectively convertable into a color producing condition upon interreaction with electron accepting acidic chromogenic reagent material.

4. A chemical type copy paper, comprising planar sheet material having a non-transferable image producing receptor layer disposed on one surface thereof;

said image receptor layer comprising the solid residue of an applied alkaline biased liquid intermixture of about 53 parts of toluene as a non-polar hydrocarbon solvent, about 13 parts of polyvinylacetate binder material, about 32 parts of opacifier-filler material, about 1 part of potassium hydroxide, about 0.2 parts of a dispersant and about 1 part of colorless tri (p-phenylamino-phenyl) hydroxy methane dispersed therewithin and being selectively convertable into a color producing condition upon interreaction with electron accepting acidic chromogenic reagent material.

* * * * *

UNITED STATES PATENT AND TRADEMARK OFFICE

CERTIFICATE OF CORRECTION

PATENT NO. : 4,327,939

DATED : May 4, 1982

INVENTOR(S) : Gerry H. Ehrhardt and Gene D. Carlson

It is certified that error appears in the above–identified patent and that said Letters Patent are hereby corrected as shown below:

Column 6, line 8, claim 1, the term "non-acidic" should appear before "resinous", and not following "resinous".

Column 3, 4th line from bottom, change "indirectly" to read -- incorrectly --.

Signed and Sealed this

*Seventh* Day of *September 1982*

[SEAL]

*Attest:*

GERALD J. MOSSINGHOFF

*Attesting Officer*

*Commissioner of Patents and Trademarks*